US006385783B1

(12) United States Patent
Eliason

(10) Patent No.: US 6,385,783 B1
(45) Date of Patent: May 14, 2002

(54) ERGONOMIC TOILET SEAT PAD

(76) Inventor: Scott Norman Eliason, 531 Greathouse Dr., Milpitas, CA (US) 95035

( * ) Notice: Subject to any disclaimer, the term of this patent is extended or adjusted under 35 U.S.C. 154(b) by 0 days.

(21) Appl. No.: 09/798,744

(22) Filed: Mar. 5, 2001

(51) Int. Cl.[7] ..... A47K 13/00
(52) U.S. Cl. ..... 4/245.1; 4/245.3; 4/245.6
(58) Field of Search ..... 4/245.1, 237, 245.3, 4/245.6, 905

(56) References Cited

U.S. PATENT DOCUMENTS

| | | | | | |
|---|---|---|---|---|---|
| 2,256,994 | A | * | 9/1941 | Warshaw | 4/237 |
| 4,048,679 | A | * | 9/1977 | Garnett | 4/237 |
| 4,189,794 | A | * | 2/1980 | Aleman-Mucino | 4/237 |
| 5,193,229 | A | * | 3/1993 | Smith | 4/245.5 |
| 5,461,732 | A | * | 10/1995 | Reiman | 4/245.3 |
| 6,154,892 | A | * | 12/2000 | Hogue | 4/237 X |

* cited by examiner

*Primary Examiner*—Steven O. Douglas
*Assistant Examiner*—Kathleen J. Prunner
(74) *Attorney, Agent, or Firm*—The Kline Law Firm

(57) ABSTRACT

Non-slip ergonomic pads are disposed on opposite sides of the upper surface of a toilet seat for supporting the gluteus maximus of a user while helping to align the pelvis and spine when the user is seated on the toilet seat. The pads are formed of a durable non-slip material which deforms slightly when sat upon and has a memory to return to its original form when the pressure of the user seated on the toilet seat is removed. The pads may include a single layer or multiple layers of open celled sponge rubber or other material. When the pads have multiple layers, the layers may exhibit a continuous gradient of values of indentation force deflection. The material should be of substantially uniform thickness so as to provide uniform pressure distribution and firm support. The pads have non-slip characteristics without being sticky to the touch. The pads may have a cloth surface layer to provide a printable surface to contain printing, advertising or a design. The pads may be affixed to the toilet seat either temporarily or permanently.

16 Claims, 6 Drawing Sheets

ERGONOMIC TOILET SEAT PAD

FIELD OF THE INVENTION

The invention disclosed herein relates to non-slip pads which are placed on top of existing toilet seats to provide ergonomic support where presently none is available. The pads also provide non-slip frictional characteristics to prevent slipping without being sticky to the touch.

BACKGROUND OF THE INVENTION

The invention is directed to the ergonomic improvement of the feel and comfort of a toilet seat, and to the provision of a non-slip pad surface. This is accomplished by utilizing cushioned material pads and specific location techniques. While not intended to be so limited, the invention will be described in its application to a toilet seat pad. It will be understood that the basic teachings of the present invention can be applied to toilet seats without lids and other types of seats.

Prior art workers have devised many types of toilet seats to improve the comfort, look and convenience thereof. Heretofore toilet seats have been constructed from rigid materials such as wood or plastic, or made from a solid core upholstered in foam padding and/or a vinyl covering. Typical rigid plastic or wood seats are not ergonomic in design. Upholstered seats and lids, with or without padding, are not particularly durable and are susceptible to cuts and tears, and do not support the gluteus firmly. Additionally, some people find the feel of padded vinyl seats to be undesirable due to the lack of support. Prior art workers have attempted to produce an all-in-one padded, resilient-type seat using complicated and costly molding methods employing catalyzed materials such as urethane covered with soft foam and vinyl, without regard for ergonomic support.

The present invention is based upon the discovery that regardless of the seat assembly, pads can overcome the above noted problems when placed in the location(s) specified. When an open cell sponge material is used, the seat is provided with a firm ergonomic surface while being soft, comfortable, and durable. The pads' surface, which has non-slip characteristics, allows reasonable mobility while using the seat. The pad provides a completely different and superior feel as compared to conventional and padded seats. The pad of the present invention is of medium density open cell sponge rubber (such as Kushon™). While it will deform slightly when sat upon, the material possesses superior memory and will return to its original form. The pad with a cloth surface also provides an aesthetically pleasing look which is easily cleaned and is available in many colors and designs.

It is an object of the present invention to provide a pad with a surface for printable media, objects and or written material.

It is an object of the present invention to provide an addition to an existing toilet seat which is ergonomic. It will be firm, yet soft to the touch, and warm and non-slip as compared to a conventional hard seat.

It is an object of the present invention to provide a portable pad providing a convenient and temporary addition to any existing toilet seat.

It is an object of the present invention to provide a pad that will create a more comfortable, ergonomic and non-slip toilet seat assembly than is achievable with existing designs and conventional construction techniques.

It is an object of the present invention to provide a pad that can be carried and utilized by a single person creating an antibacterial condition.

It is an object of the present invention to provide an ergonomic support pad that is firm and soft and that is shaped to fit the user comfortably.

It is an object of the present invention to provide a pad that is durable and pliable but with superior memory.

It is an object of the present invention to provide a pad with the above features which is easy to clean.

Finally, it is an object of the present invention to provide a support pad that is ergonomic and comfortable to the user and is effective in helping the person perform a bowel movement.

SUMMARY OF THE INVENTION

The present invention is a novel non-slip pad that is more efficient and ergonomically correct than commercially available toilet seats. The supporting surface is in contact with the surface of a toilet seat and the gluteus maximus of the user. The pad is formed using a single or multiple layers of open celled sponge rubber, (such as Kushon™), or closed celled sponge rubber or polyurethane foam. The material should be of substantially uniform thickness so as to provide uniform pressure distribution and firm support. The pad has non-slip characteristics, yet it is not sticky to the touch. The pad may or may not have a cloth surface layer, the fabric being bonded to the pad material and providing a suitable printable surface. If the cloth surface layer is not used, a non-slip smooth or textured pattern on the pad will provide a printable surface. The printing may be applied by silk screening or by a multi-material coating process. The pad has a bottom surface for resting on a supporting surface and a top surface for engageably receiving the gluteus maximus, pelvis and spine of the user. The support pad is a uniform 0.75 inch thick and can be 0.5 to 2.5 inches thick. The pad is preferably rectangular, but may be oval, quadrilateral, trapezoidal, diamond, square, circular, elliptical, pentagonal, hexagonal, heptagonal, octagonal, polygonal, heart shaped, star shaped or of a triangular shape being equilateral, isosceles, right-angled, scalene, or obtuse, as viewed in plan. When the pad is multi-sided, the corners of the pad may be rounded or bias cut. When multi-sided, it may have rounded or biased corner surfaces joining adjoining pairs of longitudinal and lateral edge surfaces. The pad may have one or more layers. The layers may exhibit a continuous gradient of values of indentation force deflection. The pad may be affixed to the seat either temporarily with Velcro™ or other temporary adherent media, or permanently by use of a permanent adhesive.

DETAILED DESCRIPTION OF THE INVENTION

Figure 1:
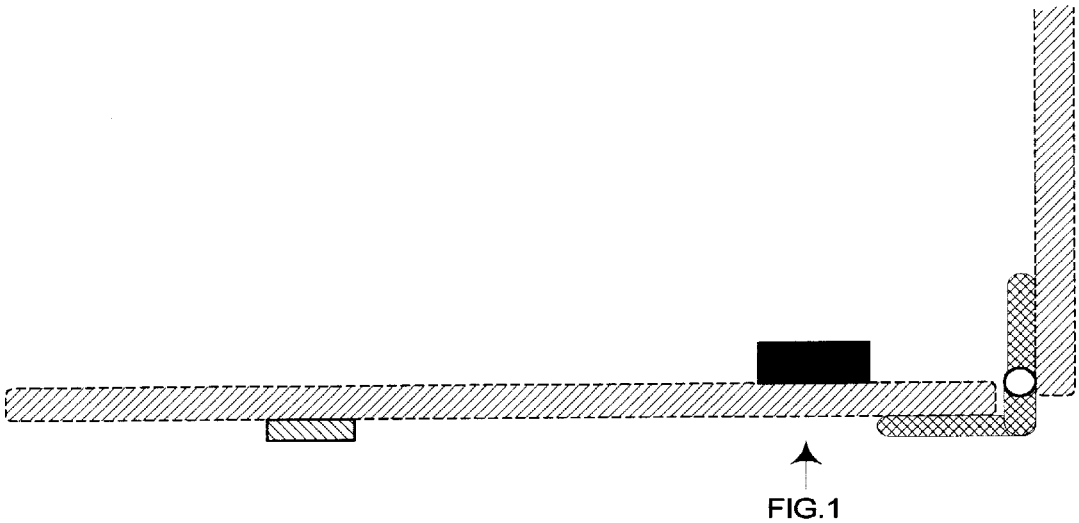
FIG. 1 is a side view of the pad of the present invention attached to a toilet seat.
Figure 2:
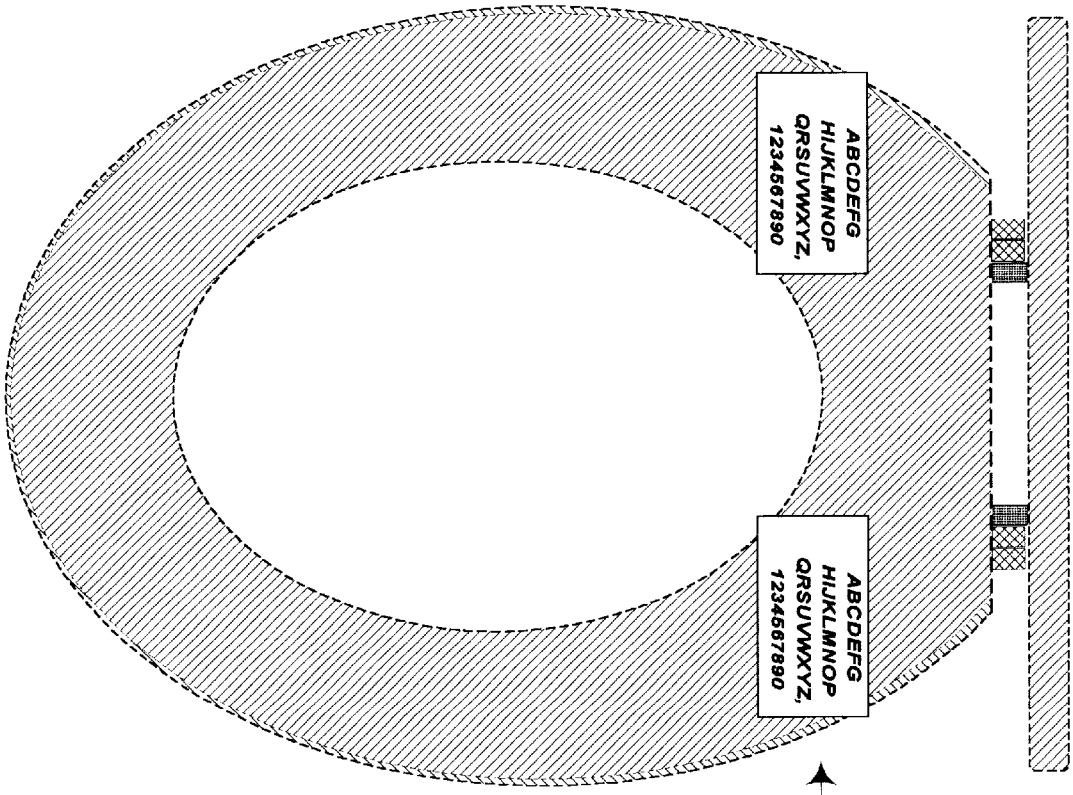
FIG. 2 is a top view of the pad of the present invention attached to a toilet seat.
Figure 3:
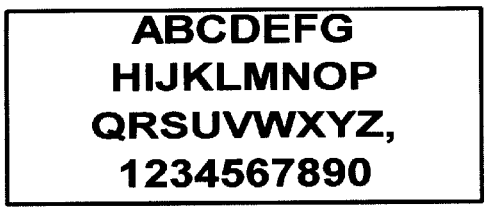
FIG. 3 is a top view of a rectangular pad.
Figure 4:
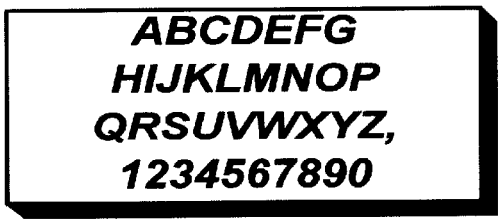
FIG. 4 is a perspective view of a rectangular pad.
Figure 5:
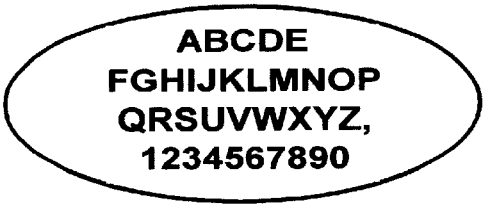
FIG. 5 is a top view of an elliptical pad.
Figure 6:
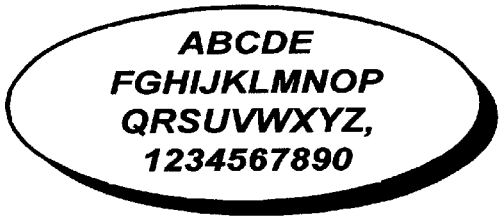
FIG. 6 is a perspective view of an elliptical pad.
Figure 7:
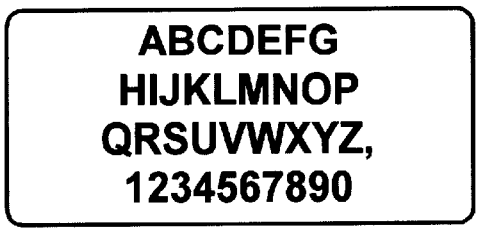
FIG. 7 is a top view of a rectangular pad with rounded corners.
Figure 8:
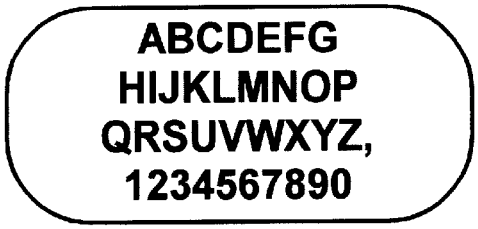
FIG. 8 is a top view of a rectangular pad with more deeply rounded corners.
Figure 9:
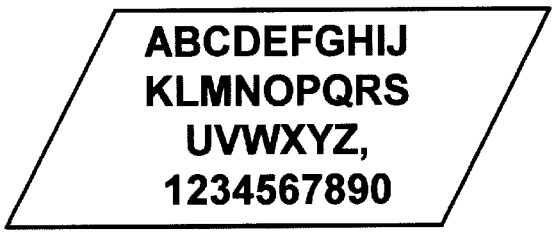
FIG. 9 is a top view of an elliptical pad.
Figure 10:
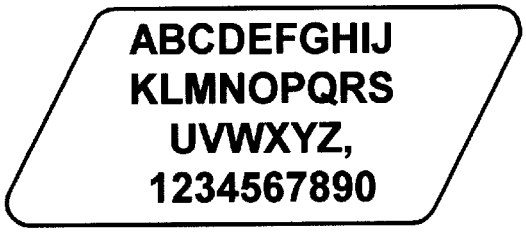
FIG. 10 is a top view of an elliptical pad with rounded corners.
Figure 11:
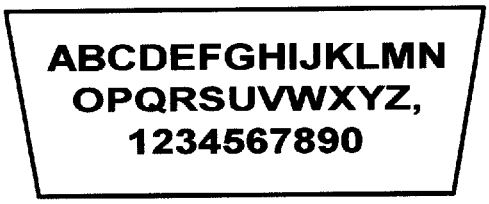
FIG. 11 is a top view of a trapezoid pad.
Figure 12:
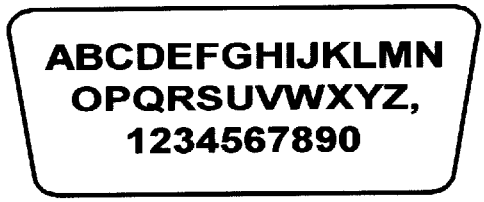
FIG. 12 is a top view of a trapezoid pad with rounded corners.
Figure 13:
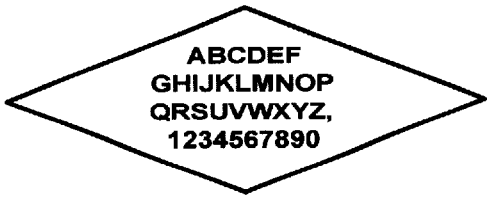
FIG. 13 is a top view of a diamond pad.
Figure 14:
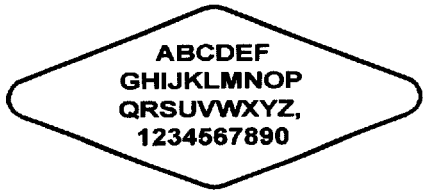
FIG. 14 is a top view of a diamond pad with rounded corners.
Figure 15:
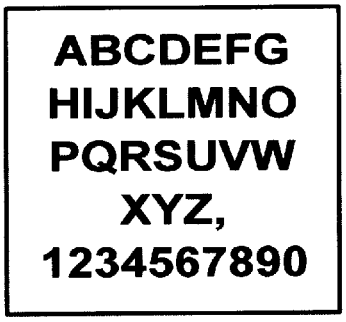
FIG. 15 is a top view of a square pad.
Figure 16:
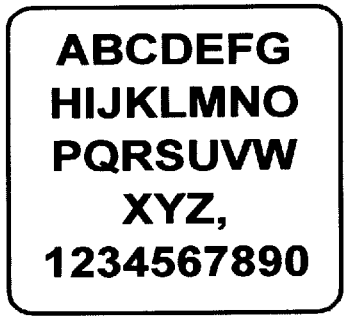
FIG. 16 is a top view of a square pad with rounded corners.
Figure 17:
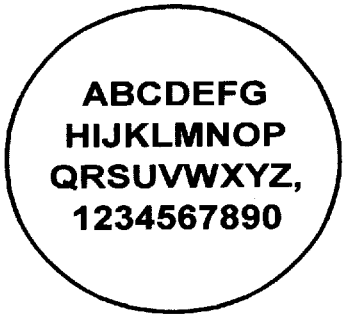
FIG. 17 is a top view of a circular pad.
Figure 18:
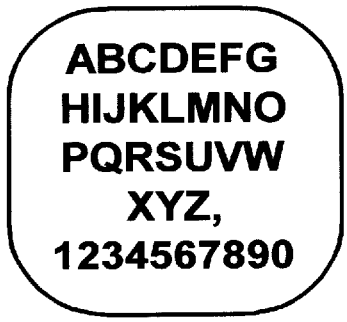
FIG. 18 is a top view of a square pad with deeply rounded corners.
Figure 19:
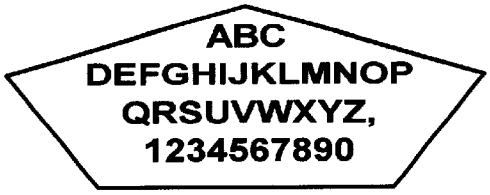
FIG. 19 is a top view of a pentagon pad.
Figure 20:
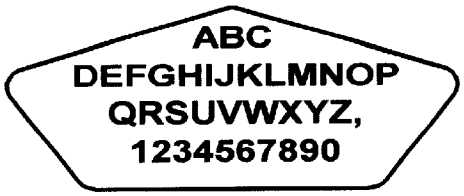
FIG. 20 is a top view of a pentagon pad with rounded corners.
Figure 21:
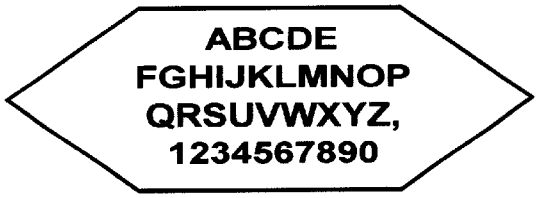
FIG. 21 is a top view of a hexagon pad.
Figure 22:
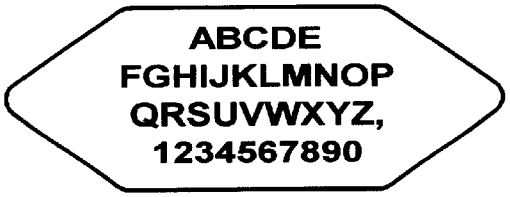
FIG. 22 is a top view of a hexagon pad with rounded corners.
Figure 23:
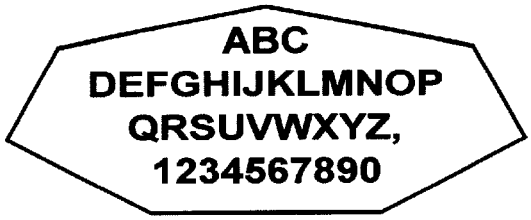
FIG. 23 is a top view of a heptagon pad.
Figure 24:
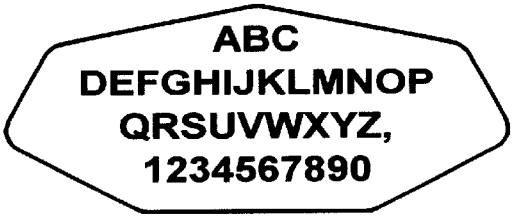
FIG. 24 is a top view of a heptagon pad with rounded corners.
Figure 25:
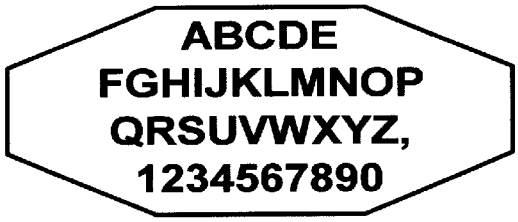
FIG. 25 is a top view of an octagon pad.
Figure 26:
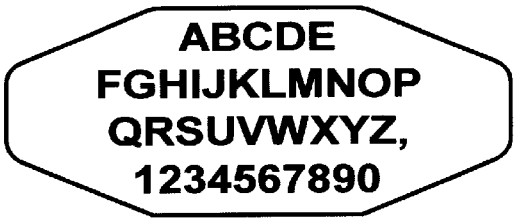
FIG. 26 is a top view of an octagon pad with rounded corners.
Figure 27:
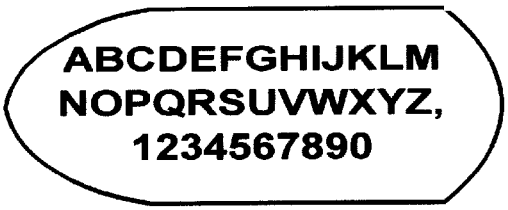
FIG. 27 is a top view of a rounded polygon pad.
Figure 28:
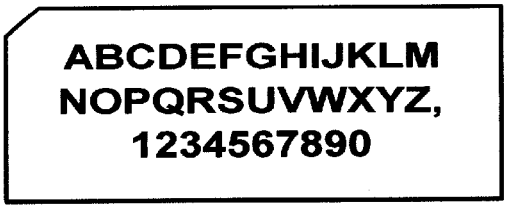
FIG. 28 is a top view of a polygon pad.
Figure 29:
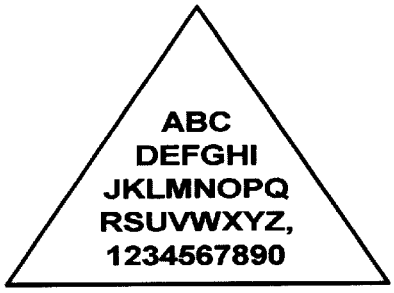
FIG. 29 is a top view of an equilateral triangle pad.
Figure 30:
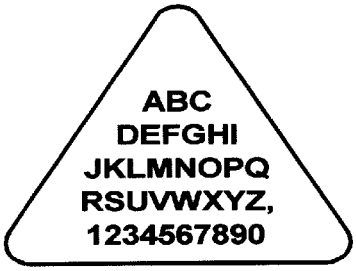
FIG. 30 is a top view of an equilateral triangle pad with rounded corners.
Figure 31:
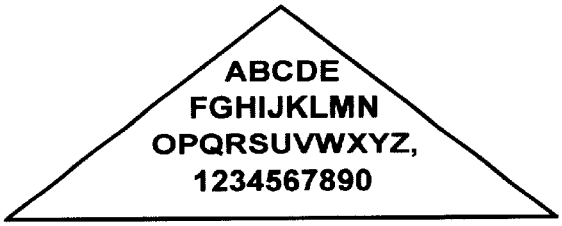
FIG. 31 is a top view of an isosceles triangle pad.
Figure 32:
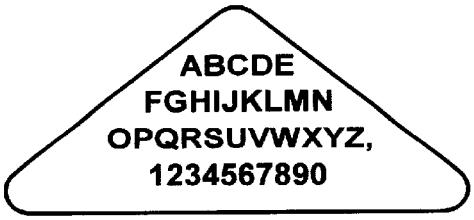
FIG. 32 is a top view of an isosceles triangle pad with rounded corners.
Figure 33:
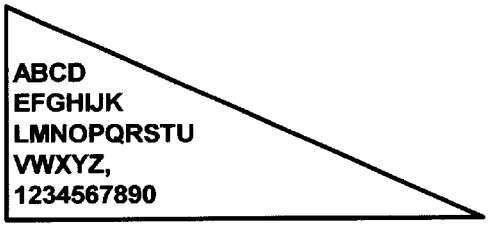
FIG. 33 is a top view of a right triangle pad.
Figure 34:
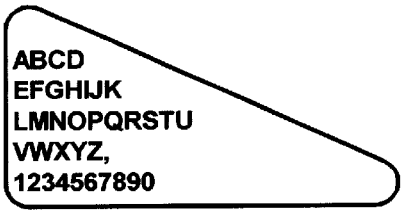
FIG. 34 is a top view of a right triangle pad with rounded corners.
Figure 35:
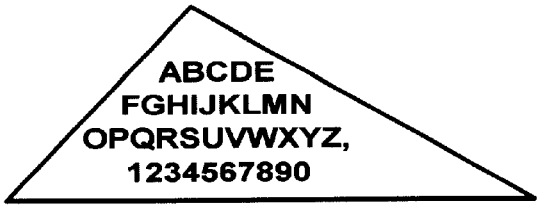
FIG. 35 is a top view of a scalene triangle pad.
Figure 36:
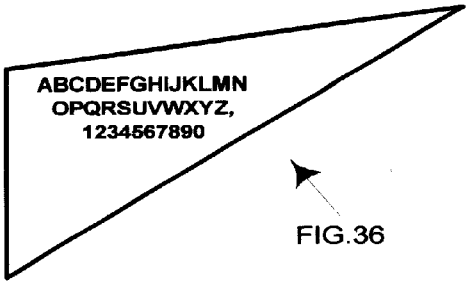
FIG. 36 is a top view of a obtuse triangle pad.
Figure 37:
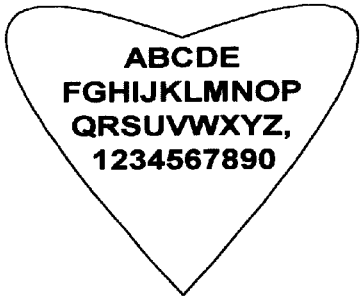
FIG. 37 is a top view of a heart pad.
Figure 38:
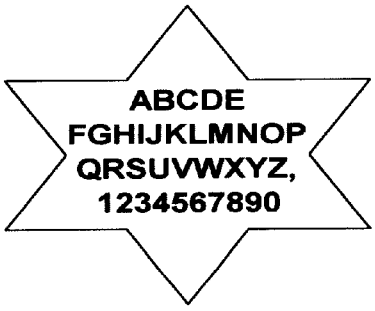
FIG. 38 is a top view of a star pad.
Figure 39:
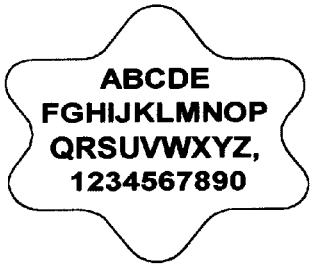
FIG. 39 is a top view of a star pad with rounded corners.
Figure 40:
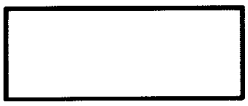
FIG. 40 is an end view of a rectangular pad.
Figure 41:
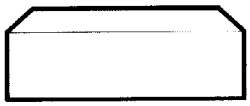
FIG. 41 is an end view of a rectangular pad with bias cut top edges.
Figure 42:
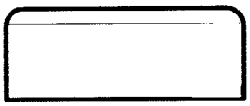
FIG. 42 is an end view of a rectangular pad with rounded top edges.
Figure 43:
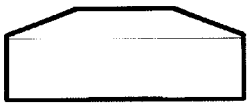
FIG. 43 is an end view of a rectangular pad with more deeply bias cut top edges.
Figure 44:
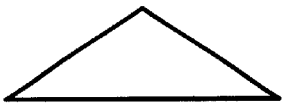
FIG. 44 is an end view of a pad with a triangular cross section.
Figure 45:
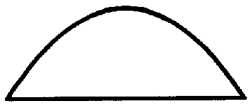
FIG. 45 is an end view of a pad with a semicircular cross section.
Figure 46:
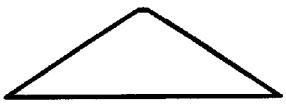
FIG. 46 is an end view of a pad with a triangular cross section with a rounded top side.
Figure 47:
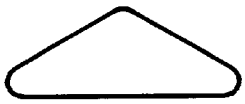
FIG. 47 is an end view of a pad with a triangular cross section with rounded corners.

The present invention is a non-slip pad, deployed in a set of two, in ergonomically strategic positions on top of a toilet seat as illustrated in FIGS. 1 and 2. A lower surface of the pad is in contact with the surface of a toilet seat, and the upper surface of the pad is in contact with the gluteus maximus of the user. The pad is formed using one or more layers of open celled sponge rubber, (such as Kushon™), or closed celled sponge rubber, or polyurethane foam. The key factors for the material used to form the pad is that it have substantially uniform thickness and provide uniform pressure distribution and firm support. The pad has non-slip characteristics without being sticky to the touch. The pad may or may not have a cloth surface layer, consisting of 100% polyester, cotton, nylon, acrylic, or weaves of a combination thereof, so that the fabric provides a suitable printable surface. If the fabric layer is not utilized, a non-slip smooth or textured pattern on the upper surface of the pad will provide a printable surface. The printable surface may have ink applied by silk screening or by a multi-material coating process. In the preferred embodiment, the support pad is a rectangle and a uniform 0.75 inch thick. The thickness of the pad can vary from 0.5 to 2.5 inches thick. In the preferred embodiment, the pad is rectangular, as shown in FIGS. 3, 4, and 7. The pad may be oval, FIGS. 8 and 18, quadrilateral, FIGS. 9 and 10, trapezoidal, FIGS. 11 and 12, diamond, FIGS. 13 and 14, square, FIGS. 15 and 16, circular, FIG. 17, elliptical, FIGS. 5 and 6, pentagonal, FIGS. 19 and 20, hexagonal, FIGS. 21 and 22, heptagonal, FIGS. 23 and 24, octagonal, FIGS. 25 and 26, polygonal, FIGS. 27 and 28, heart shaped FIG. 37, star shaped, FIGS. 38 and 39, or of a triangular shape, the triangle being equilateral, FIGS. 29 and 30, isosceles, FIGS. 31 and 32, right-angled, FIGS. 33 and 34, scalene, FIG. 35, or obtuse, FIG. 35. The corners may be square cut, rounded, or bias cut, as in FIGS. 40–47. The pad may have rounded or biased corner surfaces joining adjacent pairs of longitudinal and lateral edge surfaces. The pad may have one or multiple layers. The multiple layered pad may be formed with the layers exhibiting a continuous gradient of values of indentation force deflections. The pad may be affixed to the seat either temporarily with Velcro™ or other temporary adherent media, or permanently by use of an adhesive application. The pads are positioned so as to support the gluteus maximus of the user, and to help align the user's pelvis and spine.

To provide the pad with a high level of durability and shape memory, the pad is made from material such as open cell sponge rubber. A suitable material is "Kushon™", manufactured by Griswold Rubber Company Inc., Moosup, Conn. This material provides the high coefficient of friction for a non-slip lower surface of the pad which comes into contact with the toilet seat. Additionally, the material provides a high level of buoyancy should it fall into the toilet basin, making it easy to retrieve. This material is also easily cleaned.

Other suitable materials are closed cell sponge rubber, polyurethane foam, polyvinyl, polypropylene, polycarbonate, polyester, etc.

The inks which may be used as a coating or film are durable, pliable and long lasting, such as a plastisol ink. Water-based inks or solvent based inks can also be used. These inks are applied by silk screening or by a multi-material coating process, and are cured by drying. The silk screen process is one in which the ink or multi-material coat coloring material is forced onto the material to be printed through meshes of silk or organdy screen prepared with non-printing areas. If the pad is to contain printing, advertising (such as a logo), or a design (such as a picture, business or school emblem or logo), or other pictures or scenes, etc., the pad surface will receive color printing or coating with appropriate materials followed by a drying process.

The portability characteristics of the pad make it easy and convenient to use in public locations such as a public restroom, outhouse, portable toilet, airplane lavatory, boat lavatory, etc.

The above disclosure is not intended as limiting. Those skilled in the art will readily observe that numerous modifications and alterations of the device may be made while retaining the teachings of the invention. Accordingly, the above disclosure should be construed as limited only by the restrictions of the appended claims.

I claim:

1. Non-slip ergonomic support pads disposed on opposite sides of an upper surface of a toilet seat and positioned to support the gluteus maximus of a person and to help align the pelvis and spine of the person, said pads being formed from a durable non-slip material which deforms under pressure when sat upon, said material has memory so that said material returns to an original form when the pressure is removed, and said material provides uniform pressure distribution and support, and said pads further including a top surface to receive the gluteus maximus of a user, and a bottom surface to engage the toilet seat.

2. The non-slip ergonomic support pads of claim 1, wherein said material is open cell sponge rubber, closed cell sponge rubber, or polyurethane foam.

3. The non-slip ergonomic support pads of claim 1, wherein said pads are formed with multiple layers of material.

4. The non-slip ergonomic support pads of claim 1, wherein said pads have a cloth surface layer.

5. The non-slip ergonomic support pads of claim 4, wherein said cloth surface layer is polyester.

6. The non-slip ergonomic support pads of claim 4, wherein said cloth surface layer provides a printable surface to which ink is applied.

7. The non-slip ergonomic support pads of claim 1, wherein said pads have a uniform thickness of 0.75 inch.

8. The non-slip ergonomic support pads of claim 1, wherein said pads have a uniform thickness of 0.5 to 2.5 inches.

9. The non-slip ergonomic support pads of claim 1, wherein said pads are any one of rectangular, oval, quadrilateral, trapezoidal, diamond, square, triangular, circular, elliptical, pentagonal, hexagonal, heptagonal, octagonal, polygonal, heart, or star shaped in configuration.

10. The non-slip ergonomic support pads of claim 1, wherein said pads are in the shape of a triangle, said triangle being any one of an equilateral, isosceles, right-angled, scalene, or obtuse triangle.

11. The non-slip ergonomic support pads of claim 1, wherein said pads are multi-sided to define corners, said corners being rounded or bias cut.

12. The non-slip ergonomic support pads of claim 11, wherein said corners join adjacent pairs of longitudinal and lateral edge surfaces.

13. The non-slip ergonomic support pads of claim 1, wherein, said pads are permanently affixed to the toilet seat.

14. The non-slip ergonomic support pads of claim 1, wherein said pads are temporarily positioned on the toilet seat.

15. The non-slip ergonomic support pads of claim 1, wherein said pads are disposed on the top surface of the toilet seat near a rear portion thereof.

16. The non-slip ergonomic support pads of claim 1, wherein said pads are formed of multiple layers of material, said layers having a continuous gradient of values of indentation force deflection.

* * * * *